US006715897B2

(12) United States Patent
Rowe et al.

(10) Patent No.: US 6,715,897 B2
(45) Date of Patent: Apr. 6, 2004

(54) ILLUMINATED HAND SIGNAL

(76) Inventors: Jack R. Rowe, 1041 SE. 43rd St., Cape Coral, FL (US) 33904; Lynn F. Rowe, 1041 SE. 43rd St., Cape Coral, FL (US) 33904

( * ) Notice: Subject to any disclaimer, the term of this patent is extended or adjusted under 35 U.S.C. 154(b) by 0 days.

(21) Appl. No.: 09/908,350

(22) Filed: Jul. 18, 2001

(65) Prior Publication Data

US 2003/0016527 A1 Jan. 23, 2003

(51) Int. Cl.[7] ..... F21V 21/08

(52) U.S. Cl. ..... 362/103; 362/190; 362/191; 368/227

(58) Field of Search ..... 362/103, 190, 362/321, 191, 205; 340/321, 815.73, 815.74; 368/227, 241

(56) References Cited

U.S. PATENT DOCUMENTS

| | | | | |
|---|---|---|---|---|
| 1,496,484 A | | 6/1924 | Monaco | 362/103 |
| 3,638,011 A | | 1/1972 | Bain et al. | 362/103 |
| 4,931,913 A | * | 6/1990 | Hwang | 362/103 |
| 5,177,467 A | | 1/1993 | Chung-Piao | 340/574 |
| 5,283,722 A | | 2/1994 | Koenen et al. | 362/103 |
| 5,502,903 A | | 4/1996 | Barker | 362/103 |
| 5,535,105 A | | 7/1996 | Koenen et al. | 362/103 |
| 5,568,971 A | * | 10/1996 | Jewell | 362/103 |
| 5,577,828 A | | 11/1996 | Nadel et al. | 362/103 |
| 5,580,154 A | | 12/1996 | Coulter et al. | 362/103 |
| 5,664,346 A | | 9/1997 | Barker | 36/137 |
| 5,816,676 A | | 10/1998 | Koenen Myers et al. | 362/103 |
| 6,006,357 A | | 12/1999 | Mead | 2/100 |

* cited by examiner

*Primary Examiner*—Stephen Husar
*Assistant Examiner*—Bao Truong

(57) ABSTRACT

A portable disc flashlight, able to be secured to a user's hand, is disclosed herein. The device has a top portion, a base portion and securing means. The top portion includes a lens cover portion that threads onto the base portion. A ribbed ring portion is rotatably connected peripherally around said lens cover portion. The base portion includes an electrically energized light source and a power source for energizing said light source. A nylon strap, secured by a hook and loop fastening system allows the device to be fastened to either the palm or the back of the hand. The device further has a three-position switch that allows for off, on or flashing modes of operation.

15 Claims, 4 Drawing Sheets

ILLUMINATED HAND SIGNAL

FIELD OF THE INVENTION

This invention relates to portable lighting devices, and more particularly to a palm-mounted light with securing straps.

BACKGROUND OF THE INVENTION

Police officers and other emergency response personnel put their lives on the line every day, facing a multitude of situations that pose threats to their well-being. Often these threats are from law-abiding citizens who simply do not see them due to nighttime darkness or other instances of inadequate lighting. While flashlights do help in this regard, they must be held in the user's hand, thus making the hand unavailable for other tasks such as directing traffic, writing citations or reports, using the radio, and the like. Accordingly, there exists a need for a means by which emergency personnel and others who work in inadequate lighting conditions can be provided with the functions and usefulness of a flashlight, but without the burden of holding it. The present invention fulfills this need.

SUMMARY OF THE INVENTION

The Illuminated Hand Signal is a palm-based flashlight that is secured to the user's hand with a strap. The invention is intended for use by emergency personnel when directing traffic or performing routine tasks in a reduced light environment. A nylon strap, secured by a hook and loop fastening system such as Velcro®, allows the invention to be fastened to either the palm or the back of the hand. The invention features a three-position switch that allows for off, on or flashing. The flashing feature is especially useful when directing traffic at night. While the invention is primarily targeted at emergency personnel, the invention is great for use by anyone who needs supplemental light, but cannot be burdened with holding a flashlight in their hand. The use of the Illuminated Hand Signal provides for increased visibility and subsequent safety of emergency personnel in a manner that does not hinder the use of their hands for other tasks.

What is disclosed is an Illuminated Hand Signal comprising a top portion, a base portion and securing means. The top portion includes a lens cover portion that threads onto the base portion. A ribbed ring portion is rotatably connected peripherally around said lens cover portion. The base portion includes an electrically energized light source and a power source for energizing said light source. Means is provided for electrically coupling the power source with the light source. The securing means includes a pair of flexible nylon straps, each having frictionally engageable cloth, such as Velcro®, for adjustably fastening the signal device to the palm of a person's hand. Optionally, a flashing means is provided, along with a mode selector switch to alternately select on, off, flashing states.

It is the primary object of the present invention to provide an illuminated signal that fits in thee palm of a person's hand, and is, secured by a strap so as to leave the hands free for other tasks.

It is another object of the present invention to provide a light signal with a flasher to display in emergency road or police situations.

Yet another object of the present invention is to provide an illuminated or flashing light signal that is portable and battery operate.

Another object of the present invention is to provide a mode selectable light with on-off and flashing modes.

A further object of the present invention is to provide a band with a velcro adjustable fastener for securing the light to a person's hand.

DESCRIPTION OF THE DRAWINGS

The advantages and features of the present invention will become better understood with reference to the following more detailed description and claims taken in conjunction with the accompanying drawings, in which like elements are identified with like symbols, and in which:

DETAILED DESCRIPTION OF THE INVENTION

Figure 1:
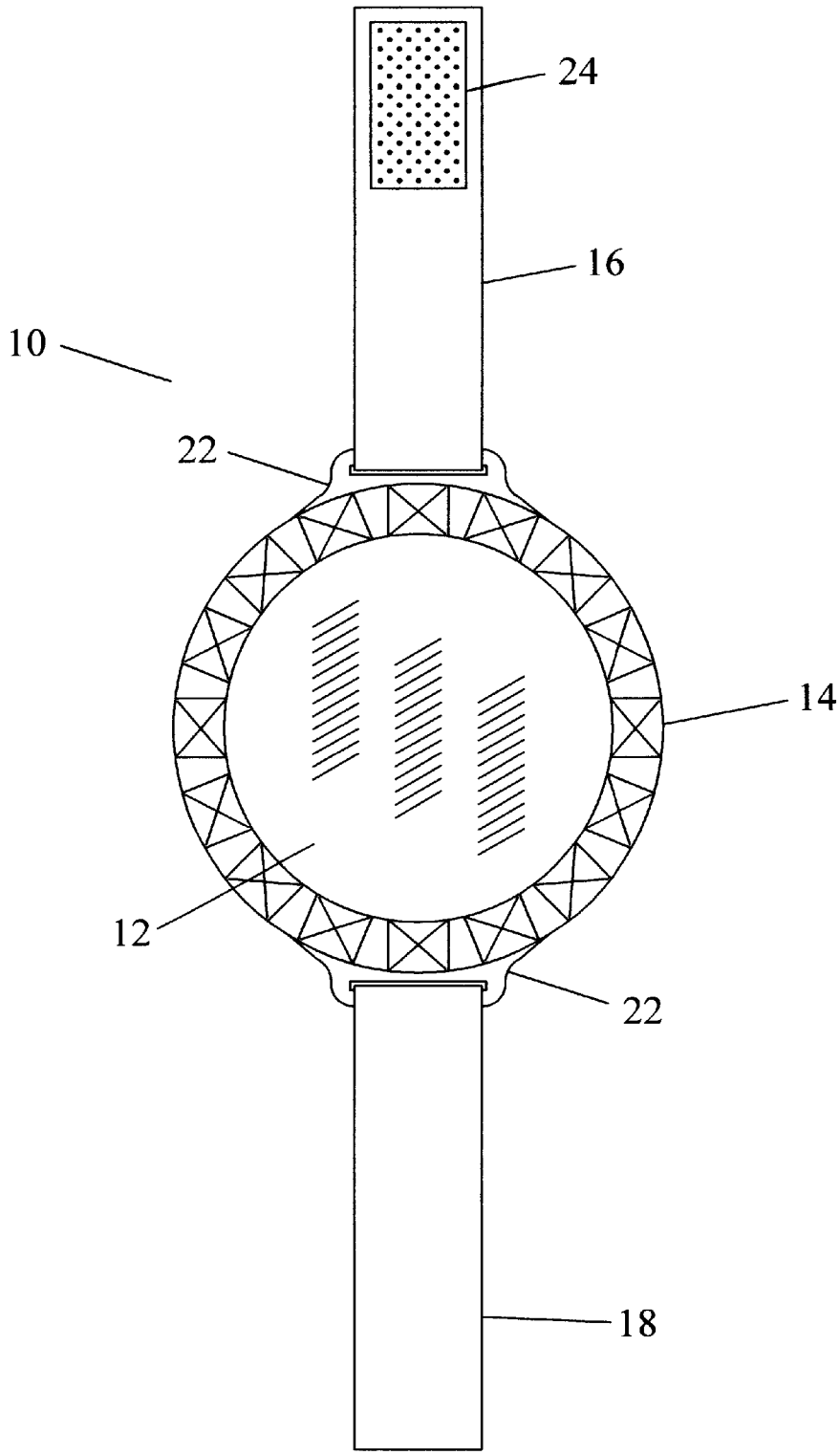
FIG. 1 is a front plan view of a preferred embodiment of the illuminated hand signal.

Referring first to FIG. 1, a preferred embodiment of the Illuminated Hand Signal 10 is shown. Lens 12 is preferably a milky-white, translucent plastic lens, although any translucent lens can be used. In the preferred embodiment, the lens 12 diffuses light emanating from within the Illuminated Hand Signal 10. A preferably ribbed outer ring 14 is rotatably mounted around the peripheral lens 12. Straps 16, 18 are mounted at opposite sides of base portion 30 shown in FIG. 2. In the preferred embodiment, strap connectors 22 are built into or mounted onto the opposite ends of the base portion 30 to receive straps 16, 18. In the preferred embodiment, the straps 16, 18 feed through and attach around strap connectors 22. The straps can be fastened to the base 30 with VELCRO®. VELCRO® patches 24, 26 are positioned at the end of straps 16, 18 to engage when wrapped around the palm of a persons hand and secure the Illuminated Hand Signal 10 on a persons hand. One of ordinary skill in the art would recognize that alternate means, including but not limit to, snaps could be used in place of VELCRO®. VELCRO® is to be used for tight fit and can be adjusted quickly for different style hands.

Figure 2:
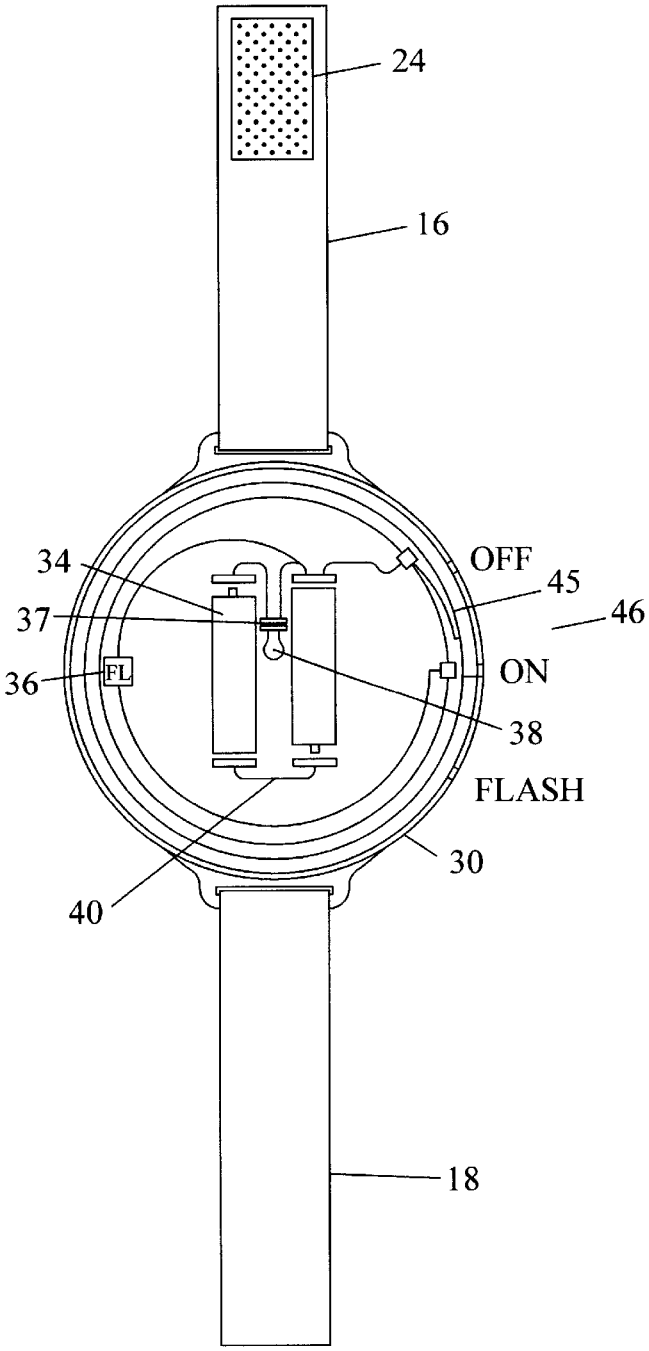
FIG. 2 is a front plan view of the illuminated hand signal with the lens removed.

In FIG. 2, the lens 12 and the outer ring 14 are removed to expose the inner parts contained in the base portion 30. A power source 34, preferably a pair of size "AA" batteries is shown in the preferred embodiment, connected in series across a mode selector means 46, preferably a switch with three selectivity points. Switch position one is the "Off" position, in which light bulb 38 is de-energized. When the contact 45 is slidably engaged with the "On" point of the mode selector means 46, the bulb 38 is continuously energized until the mode selector means 46 position is changed or the power source is exhausted. If contact 45 is slidably engaged in the next position, "Flashing", a flashing module 36 is coupled in series between the light bulb 38, and the power source 34. The flashing module 36 when energized alternately turns light bulb 38 on and off in rapid succession to create a strobe effect for improved signal visibility, for example, to a passing motorist. The power source 34 is connected by a wire to the lamp base 37. Jumper conductor 40 is used to electrically couple the set of batteries, the power source 34 used in the preferred embodiment, in series. One of ordinary skill in the art would recognize that a number of different electrical schematic, power sources and types of light bulbs can be substituted within the present invention without altering the inventor's original invention. In an alternate embodiment, a different power source including, but not limited to, a 9-volt DC battery or a solar cell may be used to power the Illuminated Hand Signal 10.

Figure 3:
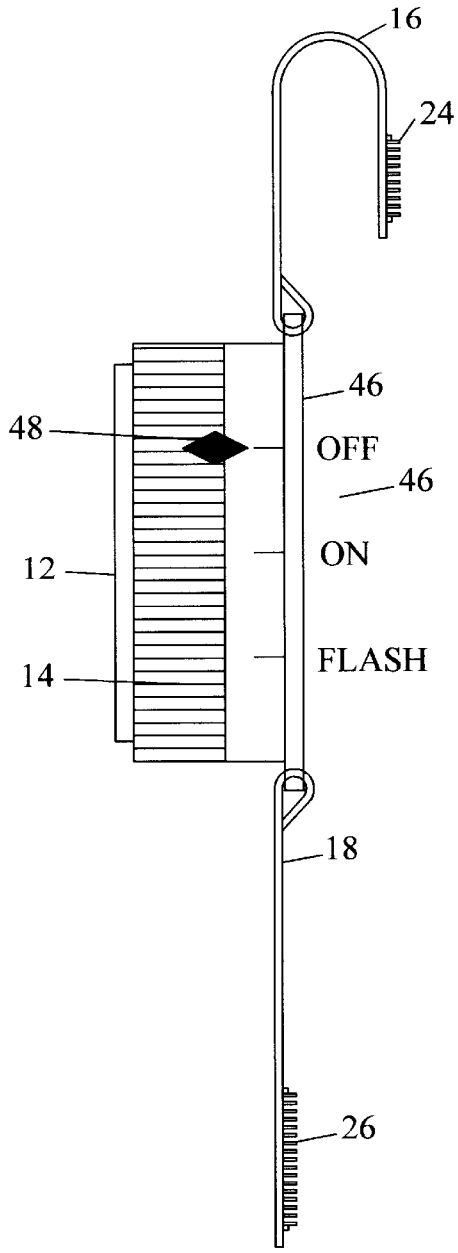
FIG. 3 is a side view of the illuminated hand signal.

FIG. 3 reveals aside view of the Illuminated Hand Signal illustrating the mode selector means 46 mounted to the base portion 30. The three positions shown Tare "Off", "On", and "Flashing". In the preferred embodiment, an indicating arrow 48 is positioned on the rotatable outer ring 14 for visible indication of the selected mode. Straps 16, 18 are shown with strap 16 curled backwards, as it would be in order to wrap around the palm of a user's hand, with VELCRO® patch 24 positioned to overlap and engage with VELCRO® patch 26 to detachably secure the Illuminated Hand Signal 10 on the front or back of a users hand.

Figure 4:
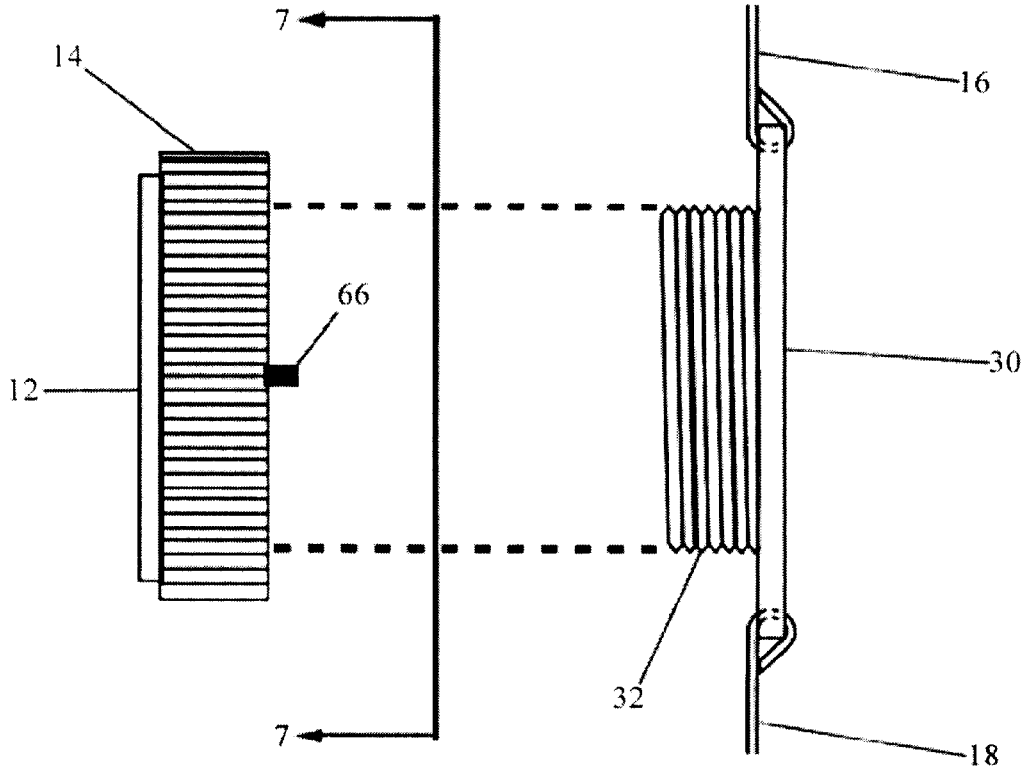
FIG. 4 is an exploded side view showing the threaded coupler for the ring and lens.

Referring next to FIG. 4, an exploded side view of the Illuminated Hand Signal, illustrates the threaded cylinder 32 that is matable with the outer ring 14. It also illustrated the attachment loop for straps 16, 18.

Figure 5:
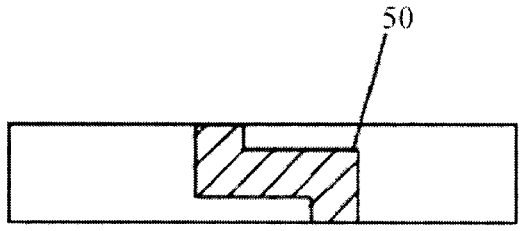
FIG. 5 is a sectional view of the inner ring locking slot.

FIG. 5 illustrates a portion of the outer ring 14, as it is preferred, with a locking slot 50 for lens 12. Lens 12 is provided with a protruding pin 64, to engage slot 50 and slidably lock in place.

Figure 6:
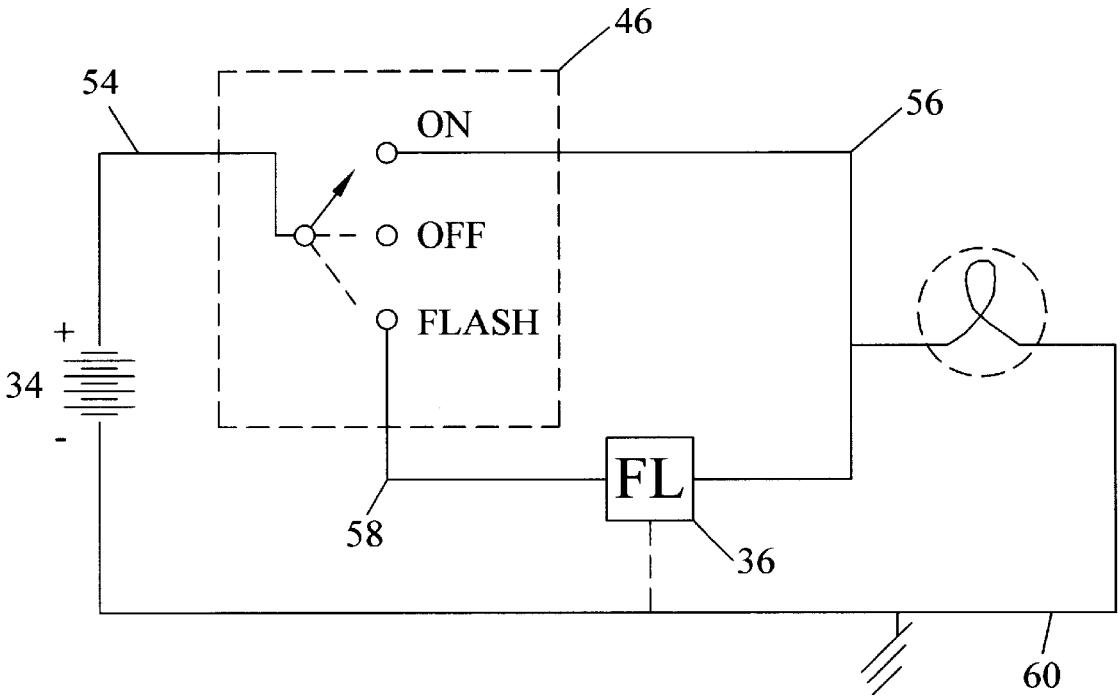
FIG. 6 is an electrical schematic of the mode selector circuit.

FIG. 6 shows a schematic wire diagram of the simple electrical circuit in the preferred embodiment. The power source 34 is coupled by primary wire 54 to the three-way mode selector means 46. Lead wire 56 coming off of mode selector means 46 is common to the mode selector 46 and output of flasher 36. Second wire 58 couples the third switch point (flashing) at the input of flasher 36. Flasher 36 has a grounded connection through ground wire 60 creating a common path back to the power source 34. One of ordinary skill in the art would readily recognize that the Illuminated Hand Signal 10 can be wired differently without altering the intentions of the inventor.

Figure 7:
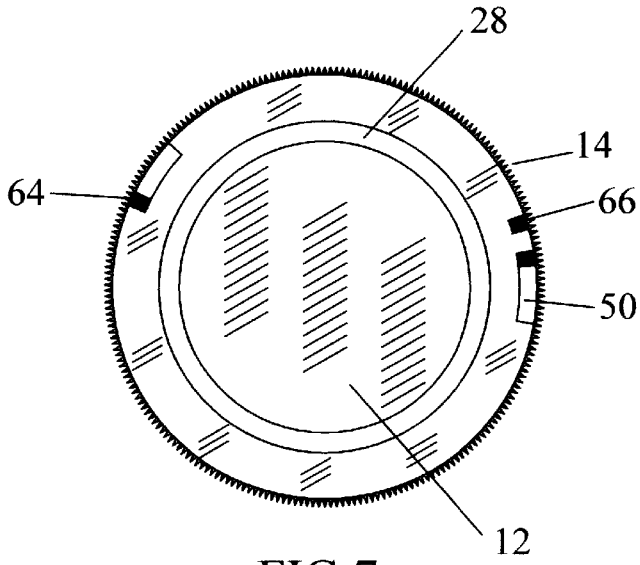
FIG. 7 is a rear plan view of the ring and lens.

Referring next to FIG. 7, a rear view of the threads 28 on the inner side of the lens 12 is shown. In the preferred embodiment, the outer ring 14 has a slot 50 in which protruding pin 64 engages to interlock lens 12 within outer ring 14. The actuator pin 66 is the switch actuator which extends downwardly from the outer ring 14 into the base portion 30 so as to rotate the position of contact 45 when the outer ring 14 is engaged by threadably mating the outer ring 14 to the base portion 30.

Thus, it can be readily observed that when the circular base portion 30 is threadably mated with the lens portion 12 and the outer ring 14 by means of threads 28 and 32, the mode selector means 46 is operable by manipulation of the outer ring 14. Ribbing of the outer ring 14, as seen in the preferred embodiment, facilitates rotational movement of the outer ring 14 such as, by a persons thumb or fingers. Light bulb 38 is thus switched on, or activated in flashing mode so that light bulb 38 is displayed through the lens 12 to visibly signal into the darkness. Thus a police officer engaged in night-time traffic control operations might utilize the invention to warn drivers, to make himself visible, to give hand signals to oncoming traffic, all the while continuing to use his hands for purposes such as writing reports or assisting, injured accident victims.

Although this invention has certain preferred embodiments, it will be obvious to those skilled in the art that various changes and modifications may be made therein without departing from the invention, and all such changes and modifications are intended to fall within the true spirit and scope of the invention.

What is claimed is:

1. An Illuminated Hand Signal comprising:

a power source;

at least one light source operatively connected to said power source;

a housing for said power source and said at least one light source, said housing comprising a base portion threadably coupled to an outer ring, said outer ring rotatably mounted to a translucent lens, said base portion comprising a pair of strap connectors formed about a perimeter of said base portion, said pair of strap connectors diametrically positioned about said perimeter; and, a pair of straps respectively mounted to said pair of strap connectors.

2. The Illuminated Hand Signal of claim 1, further comprising:

mode selector means mounted to said base portion and connected in series with said power source and said at least one light source, having an "on" position for normal operation and an "off" position for interrupting the connection between said power source and said at least one light source, said "on" position and said "off" position actuated by an indicating arrow position on said outer ring.

3. The Illuminated Hand Signal of claim 2, wherein said power source is at least one battery that provides electrical current, said power source operatively connected via a wire to a lamp base of said at least one light source.

4. The Illuminated Hand Signal of claim 2, wherein said power source is a pair of batteries that provide electrical current, said pair of batteries are operatively coupled via a jumper conductor, and said power source operatively connected via a wire to a lamp base of said at least one light source.

5. The Illuminated Hand Signal of claim 2, wherein said base portion comprises a planar surface with a threaded cylinder projecting therefrom to threadably couple to said outer ring.

6. The Illuminated Hand Signal of claim 5, wherein said outer ring comprises internal threads for receiving said threaded cylinder projecting from said base portion.

7. The Illuminated Hand Signal of claim 6, wherein said outer ring further comprises a locking slot formed along an exterior portion of said outer ring and configured to receive a protruding pin projecting downwardly from said lens thereby lockably engaging said lens to said outer ring.

8. The Illuminated Hand Signal of claim 7, wherein said outer ring further comprises a ribbed perimeter for facilitating rotational movement of said outer ring in relation to said lens and said base portion.

9. The Illuminated Hand Signal of claim 1, further comprising:

a flashing module connected in series with said power source and said at least one light source, said flashing module providing improved signal visibility to an observer; and, mode selector means connected in series with said power source and said at least one light source, comprising an "on" position for normal operation, an "off" position for interrupting the connection between said power source and said at least one light source, and a "flash"

position for alternately connecting and disconnecting the connection between said power source and said at least one light source, said "on" position, said "off" position and said "flash" position actuated by an indicating arrow position on said outer ring.

10. The Illuminated Hand Signal of claim 9, wherein said power source is a pair of batteries that provide electric current, said pair of batteries are operatively coupled via a jumper conductor, and said power source operatively connected via a wire to a lamp base of said at least one light source.

11. The Illuminated Hand Signal of claim 10, wherein said outer ring comprises:

internal threads for receiving a threaded cylinder projecting from said base portion, said base portion housing electrical wiring of said power source, said at least one light source and a contact for slidably engaging said electrical wiring;

an actuator pin extending downwardly from said outer ring so as to rotate position of said contact for engaging and disengaging electrical current;

a locking slot formed along an exterior portion of said outer ring and configured to receive a protruding pin projecting downwardly from said lens thereby lockably engaging said lens to said outer ring; and a ribbed perimeter for facilitating rotational movement of said outer ring in relation to said lens and said base portion.

12. An Illuminated Hand Signal comprising:

a power source;

at least one light source operatively connected to said power source, said at least one light source comprising a lamp base housing a light bulb, said lamp base electrically coupled to said power source via a wire;

a housing for said power source and said at least one light source, said housing comprising a base portion threadably coupled to an outer ring, said outer ring rotatably mounted to a translucent lens, said base portion comprising a pair of strap connectors formed about a perimeter of said base portion, said pair of strap connectors diametrically positioned about said perimeter;

said light bulb transmitted through said translucent lens when operatively engaged; and, a pair of straps respectively mounted to said pair of strap connectors.

13. The Illuminated Hand Signal of claim 12, further comprising:

a flashing module connected in series with said power source and said at least one light source, said flashing module providing improved signal visibility to an observer; and, mode selector means connected in series with said power source and said at least one light source, comprising an "on" position for normal operation, an "off" position for interrupting the connection between said power source and said at least one light source, and a "flash" position for alternately connecting and disconnecting the connection between said power source and said at least one light source, said "on" position, said "off" position and said "flash" position actuated by an indicating arrow position on said outer ring.

14. The Illuminated Hand Signal of claim 13, wherein said power source is a pair of batteries that provide electric current, said pair of batteries are operatively coupled via a jumper conductor, and said power source operatively connected via a wire to a lamp base of said at least one light source.

15. The Illuminated Hand Signal of claim 14, wherein said outer ring comprises:

internal threads for receiving a threaded cylinder projecting from said base portion, said base portion housing electrical wiring of said power source, said at least one light source and a contact for slidably engaging said electrical wiring;

an actuator pin extending downwardly from said outer ring so as to rotate position of said contact for engaging and disengaging electrical current;

a locking slot formed along an exterior portion of said outer ring and configured to receive a protruding pin projecting downwardly from said lens thereby lockably engaging said lens to said outer ring; and a ribbed perimeter for facilitating rotational movement of said outer ring in relation to said lens and said base portion.

* * * * *